United States Patent [19]

Aikman

[11] Patent Number: 4,532,942

[45] Date of Patent: Aug. 6, 1985

[54] MINIATURE TOBACCO FILTERS

[76] Inventor: Leslie N. Aikman, 3628 Ocean Blvd., Corona del Mar, Calif. 92625

[21] Appl. No.: 163,607

[22] Filed: Jun. 27, 1980

Related U.S. Application Data

[63] Continuation-in-part of Ser. No. 104,875, Dec. 18, 1979, abandoned.

[51] Int. Cl.[3] ..... A24D 3/04

[52] U.S. Cl. ..... 131/198.1; 131/202; 131/336; 131/212.2

[58] Field of Search ..... 131/198 R, 212 A, 198 A, 131/202, 339, 336, 341

[56] References Cited

U.S. PATENT DOCUMENTS

| | | | |
|---|---|---|---|
| 2,126,422 | 8/1938 | Tarrant | 131/212 A |
| 3,323,525 | 6/1967 | Miller | 131/198 R |
| 3,490,465 | 1/1970 | Kalbfeld | 131/198 R |
| 3,810,476 | 5/1974 | Thomas | 131/198 R |

*Primary Examiner*—V. Millin

*Attorney, Agent, or Firm*—Grover A. Frater

[57] ABSTRACT

A cigarette or cigar holder and filter, or a pipe insert, capable of removing tar and nicotine products from tobacco smoke combines a sloping, preferably conical condensate flow control target and trap with air cooling to permit smaller construction than previously available, at a cost that makes disposability practical.

6 Claims, 17 Drawing Figures

FIG. 11
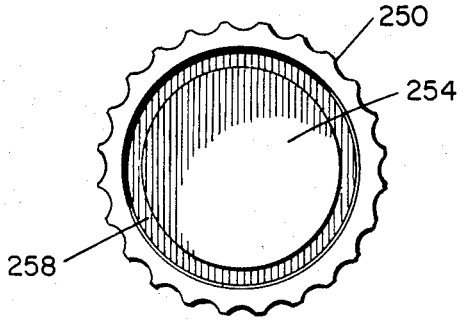
FIG. 8
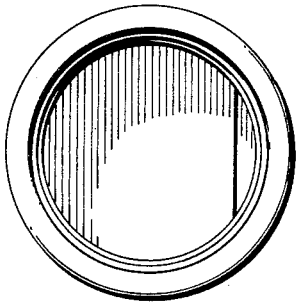
FIG. 10
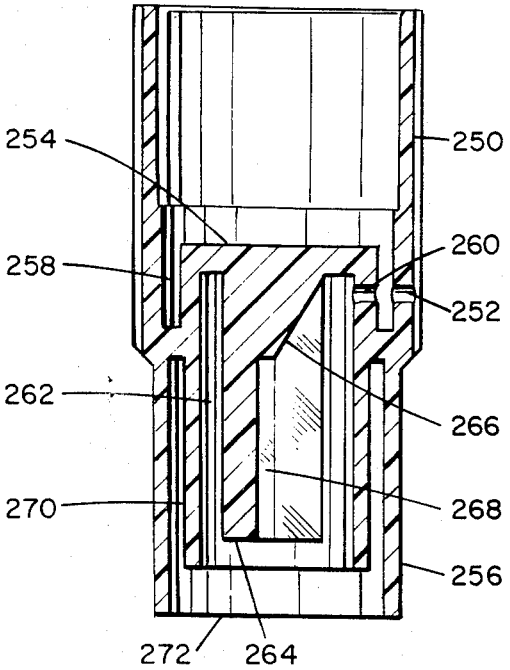
FIG. 7
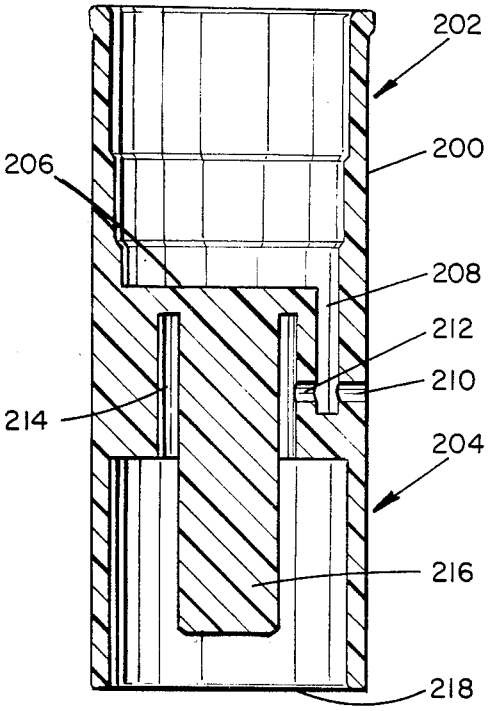
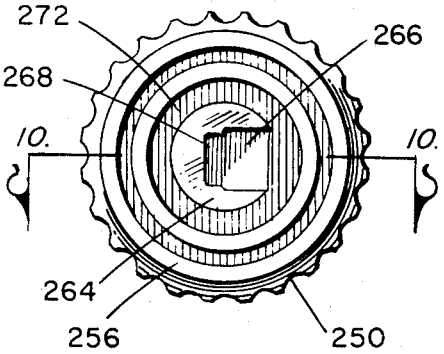
FIG. 12
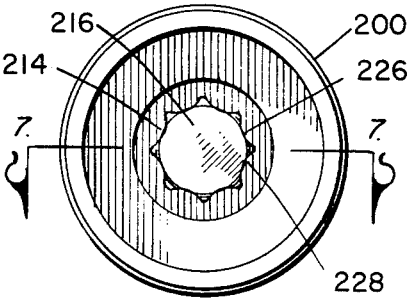
FIG. 9

FIG. 14
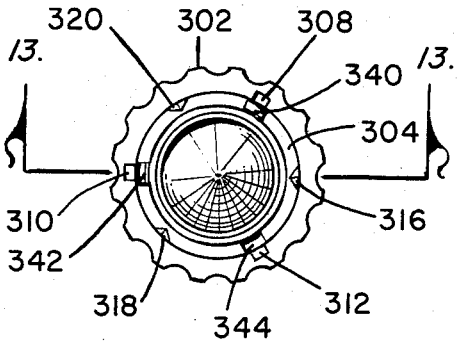
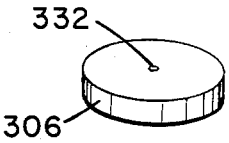
FIG. 16
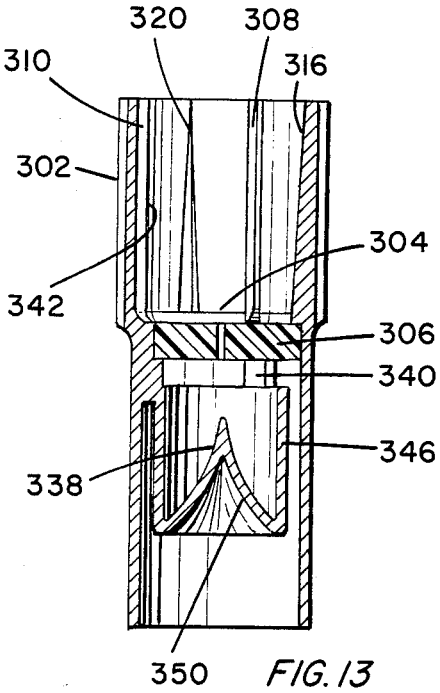
FIG. 13
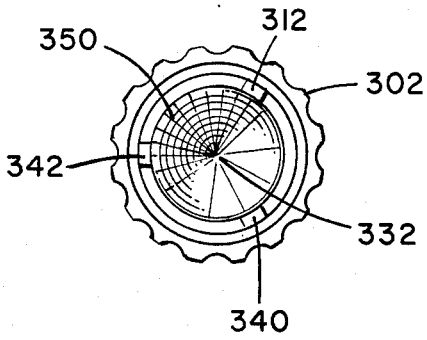
FIG. 15
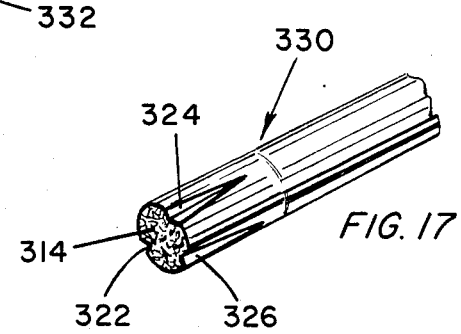
FIG. 17

MINIATURE TOBACCO FILTERS

CROSS-REFERENCE TO RELATED APPLICATION

This application is a continuation-in-part application of U.S. application, Ser. No. 104,875, filed on Dec. 18, 1979 now abandoned.

TECHNICAL FIELD

This invention relates to improvements in tobacco filters.

BACKGROUND OF THE INVENTION

For those many tobacco smokers who cannot or will not give up smoking, there are a number of devices which are effective, in some degree, in removing harmful tars, carbon monoxide and nicotine constituents from smoke. There are "filter tips" which are fixed to an end of a cigarette during manufacture. Each cigarette has its individual filter. The constraints in the area of manufacturing technique and cost faced by the designers of such filters are very formidable. They work, but usually not very well, and with little uniformity.

Far less constraint is placed on the designer of the reusable filter that can be cleaned and used over and over. The most effective of these cigarette holder-type filters combines an air inlet that opens to a mixing chamber just downstream from the cigarette end. The smoke is cooled in that chamber by being mixed with air. The more dense components, tar and nicotine materials, begin to condense to liquid and semi-liquid form.

The mixing chamber is defined by a barrier in the smoke path which is formed with an opening at which the smoke and its condensates are accelerated. Thereafter, the smoke and condensates are made to flow through a labyrinth where the condensates are made to adhere to the labyrinth wall while the smoke continues on to the bit end as the smoke inhales. The air inlet-mixing chamber-barrier part of the design is predictable, but downstream labyrinth design has proven to be anything but predictable.

The labyrinth section must meet two basic requirements. Most of the condensates must adhere to the labyrinth wall, and the cost must be low. A number of labyrinth designs which meet those requirements have been discovered. Those that have been most successful permit the removal of different degrees of tar and nicotine by changing the size of the air inlet opening to the mixing chamber and require no change in the labyrinth structure. To change air inlet opening size, it is common to market the holders in sets—each one of the set having an inlet of different size.

Holders of that type have been produced in very effective form. The several holders of a set typically remove from fifty to ninety percent of the tar and nicotine materials that would reach the user in the absence of a filter. Moreover, a large proportion of the carbon monoxide is entrained in the condensate and is removed with it. However, the most effective filter does nothing for the smoker who will not use it.

The primary reasons, it appears, why many smokers will not use, or abandon the use of, those holder-type filters is that they are too big for attractiveness, or too difficult to attach, or too messy to clean. While the problem is solved in many holder type filters, many smokers want the trapped, bad material to be relatively invisible, although discernable, so that they can know that the filter is being efficient.

Despite the number and variety of cigarette filtering devices, there is still a need, not for more effective filters, but for an effective filter that larger numbers of smokers will accept.

SUMMARY OF THE INVENTION

To provide such a filter, one that is both effective and widely acceptable, is an object of this invention.

It is a purpose of the invention to provide a tobacco filter which has an effectiveness comparable to that of the reusable cigarette holders but which is low in cost and disposable, and which need not be cleaned. It is a purpose to provide such a filter in very compact size which can be constructed such that the collected material is visible, but just barely so.

The filter provided by the invention can be produced so inexpensively that manufacture into the cigarette is feasible. However, the preferred form is used as a holder which permits different amounts of tar and nicotine product removal.

What the invention provides is a holder that can be made very short without loss of effectiveness. It can be used with at least a pack of twenty cigarettes with as much as ninety percent tar and nicotine removal.

It employs the air inlet-mixing chamber-barrier construction of the reusable filter holder units, but its labyrinth section is entirely different. In fact, no labyrinth is required, although a rudimentary labyrinth is employed in the preferred embodiment.

One of the keys is the provision of a sloping surface, preferably symmetrical and conical in the best form, downstream from the flow barrier. The sloping surface is the target for smoke and condensate flow from the flow barrier. Another key is an arrangement of sloping surface, condensate trap and flow path defining structure that permits the holder, except in one version for the barrier wall to be molded as a single unitary structure. That feature makes low cost production possible while retaining condensate removal capability at any selected percentage level.

In addition to being effective and inexpensive to produce, the conical shape of the condensate collection element minimizes clogging to provide a uniform result and "feel" from the first to the last of at least a whole pack of cigarettes.

The holder is applicable to cigars as well as to cigarettes, and is applicable as well as a filter insert in pipe stems for pipe smokers.

Moreover, since the invention is useful, whatever the specific form of the sloping surface, the invention permits configurations that can be molded to form a one-piece unitary holder or filter structure.

One preferred form is a variation of a more basic structure developed to permit one-piece construction by a plastic molding process. The one-piece forms utilize the ambient air inlet to create the stream that carries condensate to the sloping surface. Because the sloping surface is to remain wet so that the force of the smoke air stream will push and slide condensate from the impact area of the sloping surface to a collection point, less air cooling is required. The requirements of condensation, air-smoke stream and sloping target surface can be met without the conventional arrangement of an air mixing chamber upstream from a barrier having a central opening. Indeed, the cooling can be accomplished in the stream just prior to striking the sloping target.

Thus, in a broader sense, it is an object of the invention to make possible alternative kinds of air cooling and air-smoke stream formation structures for use with a sloping target condensate collector.

Another preferred form provides a functional advantage in that it improves air mixing efficiency and permits a reduction in cooling chamber volume. It also provides an important cost advantage in that it eliminates the lateral air inlet which is costly to produce. Inlet air is introduced via channels formed in the inner surface of the cigar or cigarette retaining section of the holder. While that feature offers special advantage when coupled to the sloping tar collection surface of the invention, it can be employed with other filter designs and configurations.

THE DRAWINGS

In the drawings:

FIG. 7 is a view in cross-section of another embodiment of the invention taken on a plane through its longitudinal axis represented by line 7—7 in FIG. 9;

FIGS. 8 and 9 are end views of the unit of FIG. 7 showing the upstream and downstream ends, respectively;

FIG. 10 is a view in cross-section of still another embodiment of the invention taken on a plane through its longitudinal axis represented by line 10—10 in FIG. 12;

FIGS. 11 and 12 are end views of the unit of FIG. 10 showing the upstream and downstream ends, respectively;

FIG. 13 is a cross-sectional view, taken on a plane that contains its central, longitudinal axis, of still another preferred embodiment of the invention configured as a cigarette holder;

FIG. 14 is a view looking into the cigarette receiving or upstream end of the holder of FIG. 13 except that the barrier member is omitted for the sake of clarity;

FIG. 15 is a view looking into the downstream end of the holder of FIGS. 13 and 14, the barrier being omitted;

FIG. 16 is a perspective view of the barrier member; and

FIG. 17 is a perspective view of the end of a cigarette as it appears after having been inserted into the holder of FIGS. 13 through 16.

Each of FIGS. 2 through 16 is greatly enlarged.

DESCRIPTION OF THE PREFERRED EMBODIMENTS

Figure 1:
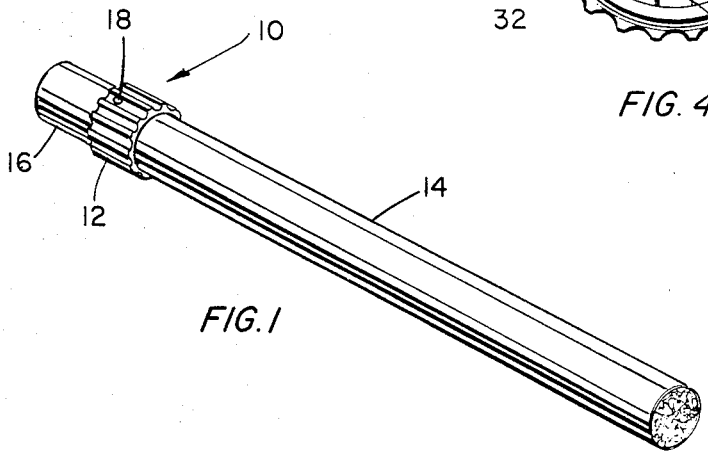
FIG. 1 is a perspective view of a cigarette and a filter holder which embodies the invention.

The holder 10 of FIG. 1 can be described as comprising two sections, a forward or upstream section 12 into which the cigarette 14 is fitted, and a rearward section 16 which the user holds between his lips. The cigarette is inserted to a position stop in section 12. It does not cover the air inlet opening 18 which extends through the holder wall.

At section 12 the outer wall is formed with flutes. They extend parallel to the axis of the holder and are spaced around the periphery of the forward section. Ordinarily, they are held between the user's index and middle finger, or the index finger and thumb. Hole 18 is positioned at the bottom of a flute where it cannot be closed by the user's fingers. In fact, in the preferred embodiment, the smoker's fingers, or index finger and thumb, engage the cigarette body rather than the holder. Thus, he experiences the feel of the cigarette itself rather than a foreign material, metal or plastic.

The downstream section 16 is cylindrical and has a substantially smooth outer surface. It need not, in fact, be longer than is required for the smoker to hold it comfortably between his lips. That characteristic marks this holder as very different from earlier air cooling filters. Earlier holders were long and usually arranged with a bit to be held between the smokers's teeth. Weight and length were not critical as in this device which, when held in the smoker's mouth, is held only by the lips.

Figure 2:
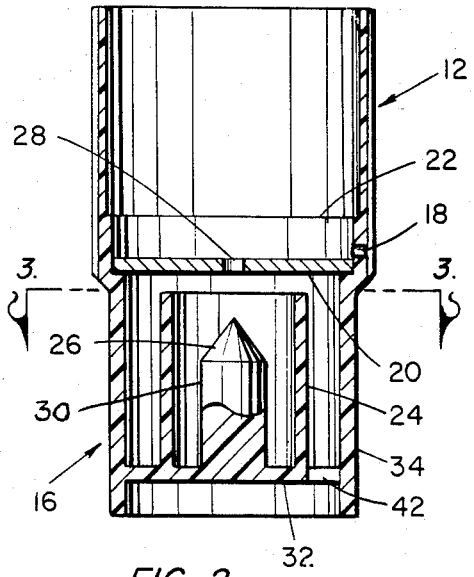
FIG. 2 is a cross-sectional view of the filter holder of FIG. 1 taken on a plane through its longitudinal axis.

The holder is shown greatly enlarged and in central longitudinal section in FIG. 2. The upper, upstream section 12 is separated from the downstream section 16 by a thin, transverse barrier plate 20. The barrier is press-fitted into the upper section and it rests at its peripheral margin on a shoulder which results because the inner diameter of the lower section 16 is slightly less than the inner diameter of the upper section. The inner diameter of the upper section is also stepped at a shoulder 22. Above the shoulder, the inside diameter is slightly larger.

The shoulder 22 is just above, upstream, of air inlet opening 18 and it marks the depth to which a cigarette is to be inserted into the holder. The shoulder provides a tactile signal to indicate that a proper depth has been reached.

The space from shoulder 22 to the upper face of barrier 20 forms the mixing chamber in which air drawn through inlet 18 is mixed with smoke. Its function is to cool and condense the tars and nicotine substances to liquid form.

Using the inside diameter of the coupler, which is the same as cigarette diameter, it will be apparent that the mixing chamber in this preferred embodiment is smaller than in prior art devices. In prior devices, an attempt is made to not only liquify tars and nicotine products but to turn them into semi-solids. Changing the size of the air inlet opening changes the degree in which there is cooling to semi-solid form and, therefore, the proportion of tar and nicotine product that is removed from the smoke. To insure that the degree of removal of the harmful constituents was a function of air inlet size, the labyrinth section of the conventional "withdrawal kit holder" was arranged to trap only the semi-solids and larger liquid droplets.

In this holder, the mixing chamber is smaller and smoke swirls for a shorter period. Cooling and semi-solid formation is less. The reduction in chamber size can be overcome by enlarging the air inlet opening, but to do that would compromise the "feel" of inhalation suction and, for some smokers, taste. In this embodiment, the reduction in semi-solid formation is solved downstream from the barrier in the labyrinth section. However, this holder does not rely on a labyrinth. That is not immediately apparent because the preferred embodiment includes a sleeve 24 which provides a rudimentary labyrinth. The upper part of the sleeve is omitted in the embodiment shown in FIGS. 5 and 6. This embodiment includes no labyrinth.

Returning to FIG. 2, one key is the conical element 26. The axis of the cone coincides, or almost so, with the axis of the holder and the central, circular opening 28 in the barrier. The apex of the cone extends toward the barrier opening 28. Experimentation indicates that spacing is not particularly critical. Spacing from 0.1 to 8 millimeters produced satisfactory results in the case of forty-five degree right cones. Smoke and condensate is accelerated to high velocity as it passes through hole 28. The unit is symmetrical about its longitudinal axis. Inhalation suction causes a uniform flow about that axis and the smoke and condensate is directed at the cone and, in particular, at the region around the apex.

Arriving smoke containing condensates impinges upon the cone's sloping surface. The condensates will strike the inclined plane and adhere to it. At the same time, because of the inclined plane, the heavier particulate matter is forced to flow down the cone's inclined plane instead of being returned to the smoke mixture to be carried downstream into the smoker's mouth. Experimentation has indicated the preferred angle for the cone is approximately forty-five degrees. At less than forty degrees, the impact is effective but less than ideal. The condensates begin to glance away with the smoke stream rather than adhere to the cone. At an angle greater than fifty degrees, condensates tend to be concentrated on the sloping surface so that the unit becomes clogges prematurely. The action is effective, however, for all angles in the range of thirty to sixty degrees. The entire conical surface is wetted with condensate after a few inhalations. Subsequently arriving condensate impinges on the cone's wet surface and joins the liquid film. All the collected condensate, except a thin layer, is forced to move toward the base of the cone as it is subjected to sheer force imposed by the continuing stream of smoke and condensate. The portions of condensate which have not adhered to the conical surface are forced into the collection reservoir or "trap" below the base of the cone. In this embodiment, the conical structure 26 forms the upstream end of a cylindrical stub 30 which extends in the upstream direction from a transverse base flange 32.

The cone and stub are quite small. The diameter of the stub is only about one-fifth of the inner diameter of the encompassing wall 34 of the downstream section 16.

The cylindrical wall or sleeve 24 is positioned in the mid-region between the outside of the stub 30 and the inside of the outer wall 34. It is a thin-walled sleeve that extends upwardly from flange 32 to a level above the apex of the conical target 26. In this preferred embodiment, the separation between the top of the sleeve and the bottom of the barrier 20 is about one millimeter. The separation between the bottom of the barrier and the apex of the target is about three millimeters. There are three exit openings in this embodiment by which smoke can pass from the holder to the smoker. Those openings are formed as cutouts around the outer periphery of flange 32. Three legs, spaced one hundred twenty degrees apart, remain. The legs are numbered 37, 38, and 39, respectively, in FIG. 3. For the sake of identification, the exit opening that is visible in FIG. 1 has been given identifying number 42.

The sleeve 24 serves three functions. The most improtant of the three is to prevent the condensate that slides down the conical target and the sides of the stub from flowing or being blown to the exit openings. It is the lower portion of the sleeve, that portion adjacent to flange 32, which performs this trapping function. The middle section along the height of the sleeve serves to hide somewhat the condensate from view. This is an important feature which has a very direct bearing on user acceptance and, therefore, on the positive contribution that a filter can make in minimizing the harmful effects of smoking. If to hide the condensate was the only requirement, the holder could be made of an opaque material. However, there is another requirement. Filter users want assurance that the filter is "working." They want to be able to see enough to know that the harmful material, the tar and nicotine, are being removed and are being trapped. On the other hand, users want that visibility to be so limited that they are spared the feeling, while smoking, that they are putting something dirty in their mouths. The proper compromise is reached by making the holder of a translucent plastic colored smoky brown or by simply "frosting" otherwise clear plastic.

To add an inner element to trap tar and nicotine, and additionally, to decrease visibility of that tar and nicotine, and to give the user something to see inside the outer wall that he can believe will make the holder effective, appears straightforward and simple. This is not such a simple matter, however, when it is remembered that those functions, and the function of getting the condensates into the trap, are to be performed in a filter section where total length is only slightly more than the diameter of a cigarette, and whose diameter is no greater and may be less than that of a cigarette.

This preferred embodiment is intended to be a low cost, disposable unit in which the trapped tars and nicotine are trapped so that they cannot flow out to make a mess. That is, it is an object to provide a holder which may be disposed of in an ash tray or any other trash recepticle without regard to orientation, without the trapped material being exposed or leaked, and without an offensive appearance. This embodiment provides such a unit which can easily serve for twenty cigarettes and which can be made in one or two pieces. In this case, the barrier is made of metal as one piece, and all of the remainder of the holder is made in one piece as a plastic molding.

The downstream end should have a protective appearance either by a full rear edge (as in the embodiment of FIG. 5) and/or by recessing the filtering elements. Recessing is shown in the preferred embodiment of FIG. 2. To provide the recess reduces the volume available to accomplish filtering, but that sacrifice of volume is made to provide a feeling of assurance that the trapped bad materials cannot possibly be released to the user's mouth. The fluted arrangement at the forward end provides a means for insuring that the air inlet 18 will not be closed by the user's fingers.

When the holder is in use, the filtrate collects between the stub 30 and the inner downstream end of the sleeve 24 adjacent the flange 32. A separation of at least one millimeter between stub and sleeve is preferred to prevent blocking of the entrance to that space by semi-solids.

The fact that the mixing chamber in section 12 of the holder is smaller than is customary means that there is less cooling and less semi-solid material moving through the barrier opening to strike the target. The condensate is more liquid. This results in the target cone remaining wet and remaining generally free of filtrate. The condensate flows down the stub into the reservoir.

The target 26 is conical. The conical shape functions best. That is fortunate because it is more easily produced than pyramidal, wedge, and other "sloping surface" shapes. Since the filtering action involves striking a sloping surface, adhering to that wet surface, and then being forced to slide or flow or otherwise move down that surface, it follows that other sloping shapes will be effective as targets. They are effective particularly when symmetry is preserved. A wedge shape may be substituted for the conical target 26. All that is required is to form a sloping surface in the flowpath downstream from the barrier opening 18. If a pyramidal shape is used, its apex should lie on the centerline through opening 18. Those other shapes are contemplated within the invention. But the smoothest, greatest surface area, least likely to become fouled with filtrate, is the cone. The best angle appears to be forty-five degrees. More than sixty degrees from the axis is too flat to provide proper action, and less than thirty degrees is not very effective. The conclusion is that the angle of the slope measured from the central axis to the surface, inside the target, should be not less than thirty nor more than sixty degrees.

The sleeve 24 was described as performing three functions. The third function is provided by its upstream portion. It has been discovered that a step improvement in filtering efficiency is realized, as the sleeve is made longer, as soon as its upper rim extends past the apex of the target toward the barrier. The increase has been named the labyrinth effect, although the reason for it is not clear. It does not change the action at the target or the manner or place at which the filtrate is collected except to increase the amount collected. As a consequence, this long sleeve design is very useful when it is the objective to remove a large percentage, eighty or ninety percent, of the tar and nicotine products from smoke.

In terms of overall usefulness and advantage, a filter that removes from fifty to sixty percent of nicotine, tars and carbon monoxide is probably best in the sense that more smokers will accept such a reduction in nicotine level for a protracted time. Removal of more of the nicotine in a single stage is less acceptable. Some smokers report that the holder does not feel right or "draw" right, and that may be an indication that more design improvement has been needed. Other smokers report that they are not satisfied with taste if the removal rate is too high. That may mean that the smoke is cooled too much, or it could mean that there is a threshhold of tar content or nicotine content below which the change is discernible to the taste. Whatever the reason behind taste test failures, acceptability can be improved by increasing odor. Odor can be increased by the simple expedient of decreasing the distance from the ignited end of the cigarette to the smoker's nose. That suggests shortening the holder, and one way to accomplish this is to minimize the size of the filter. Another way is to incorporate the filter in the cigarette during production.

Figure 4:
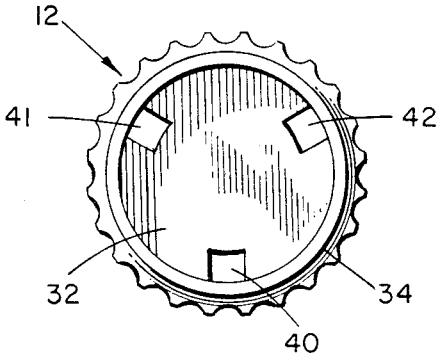
FIG. 4 is a bottom view of the holder of FIGS. 1, 2 and 3.
Figure 5:
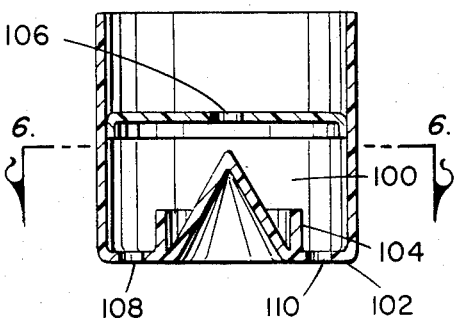
FIG. 5 is a cross-sectional view of an alternative form of the invention taken on a plane through its longitudinal axis.
Figure 6:
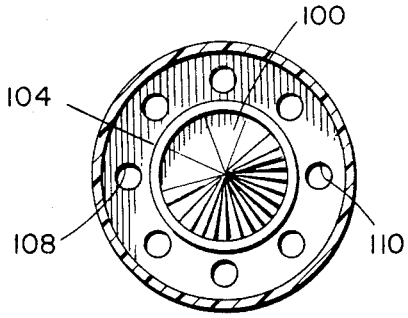
FIG. 6 is a cross-sectional view taken on line 6—6 of FIG. 5.

A filter suitable for inclusion in cigarettes or as a filter in pipes, or as a cigarette or cigar holder, is shown in FIGS. 5 and 6. This one differs from the unit of FIGS. 1 through 4 in that the target 100, which is conical, extends down to the flange 102 which is actually the downstream end of the holder. In this unit, the sleeve 104 is very short. It serves as a trap for filtrate which sloughs down the sides of the target but is not long enough to hide the filtrate. And, of course, the sleeve is far too short to provide what was called "labyrinth effect" above. In this case, the barrier 106 is a plastic insert. The outlet openings are round and are spaced around the short sleeve 104. For identification, openings 108 and 110 are numbered.

The preferred forms evolved from the holders shown in FIGS. 7 and 10 which can be manufactured as unitary, one-piece structures. In each case, a mixture of smoke, air and condensate is formed into a stream and made to impinge upon a sloping target surface. In the unit of FIG. 7, the sloping surface is formed by the sides of two longitudinal flutes. The line that the two flutes share as a common border bisects the smoke-air-condensate stream to present a wedge shape as described above. In the unit of FIG. 10, the sloping surface is oriented differently. It slants across the longitudinal axis of the unit at an angle. In the case of each unit, the cooling of the smoke and the formation of condensate begins in the smoke-air stream and the air inlet opening is utilized to form the stream.

In FIG. 7, the body 200 of the holder is cylindrical. The upstream end 202 has its interior wall stepped to different interior diameters to accommodate cigarettes of different size. The upstream end 202 is separated from the downstream end 204 by a barrier wall 206. The upstream surface of the barrier wall is generally flat, but at one edge it is deeply recessed to form a smoke passage 208 that intersects the air inlet passage 210. Beyond the intersection of those two passages, the air inlet passage continues and serves as a combined smoke and air passage 212 in which there is a cooling of the smoke and the beginning of condensation. The combined smoke-air-condensate stream emerges from the passage into an annular chamber 214 which encompasses a central tar and nicotine collection element 216. Except that its exterior is fluted longitudinally, this element is cylindrical with its axis coincident with that of the holder itself. In the annular chamber, the smoke and air of the stream expand. They are further cooled and more condensate is formed. However, the stream continues across the annular chamber and strikes the fluted surface of the collection element. The flutes are oriented so that the edge at which two flutes join bisects the smoke-air-condensate stream whereby two sloping surfaces are presented to the stream. The condensate strikes those surfaces. They become wet and condensate adheres to them. The force of the stream urges the condensate away from the target area down the slope and then, in this case, toward the outlet end 218.

After the condensate is forced out of the annular chamber 214 into the upstream end of the larger annular chamber 220 below the barrier, its movement ceases because the stream of air and smoke is dispersed in the larger area. Its velocity is decreased and the stream is dissipated as it flows to the outlet.

The fluted construction and orientation of the flutes is best shown in FIG. 9 where the air inlet and smoke and air inlet passages are indicated by dotted lines. Smoke and air and condensate are directed at the adjacent sides of flutes 226 and 228. The shape of the smoke inlet passage can be understood by comparing FIGS. 7 and 8.

The embodiment shown in FIGS. 10, 11 and 12 has an exterior appearance similar to that of the unit of FIG. 1. Its upstream end 250 is fluted and the air inlet opening 252 is located at one of the flutes. The barrier wall 254 separates the upstream end from the downstream end 256. The central area of the barrier projects into the upstream cigarette "coupler" section so that an annular cavity 258 is formed around that central area. The annular cavity serves as a smoke flow passage which intersects with the air inlet passage 252 at the entrance to the combined smoke and air passage 260. Cooling begins in this passage and the formation of condensate begins. Smoke, air and condensate flows in a stream from passage 260 in response to inhalation suction into the annular chamber 262 surrounding collection element 264. The smoke and air expand on entering this chamber, and more condensation occurs. Nonetheless, smoke, air and condensate still move in a stream and impinge on the sloping surface 266. As in the other embodiments, the target surface is wetted by initial quantities of condensate. Additional condensate is forced down the sloping surface by the smoke and air stream to the slot 268 where it collects.

In this embodiment, one side of the collection element is cut away to form what is shown in FIG. 12 to be a generally C-shape in end view. The upstream end of the cut-away portion slants off toward the smoke and air passage 260 to form surface 266. The slot or groove 268 is formed by a further cutting away of the inner surface of the C-shape.

A sleeve 270 extends concentric with the outer wall and the inner collection element from the barrier wall 254 to a point short of the exit end 272 of the holder, but beyond the end of the collection element. It is disposed midway between the outer wall and the collection element. Its function is to direct flow in the region of the sloping surface and to make the collected tar and nicotine products less visible from the exterior of the semi-transparent structure.

The embodiment illustrated in FIGS. 13 through 16 is a cigarette holder, although its features are applicable to other tobacco products including slender cigars and regular cigars. It differs from the other embodiments primarily in that it does not have an air inlet hole that extends through its side wall. Ambient air enters the mixing chamber through a number of passageways molded as longitudinal grooves in the inner surface of the coupler portion of the holder. The grooves extend from the rim at the forward edge of the holder to the insertion limit stop and into the mixing chamber. It has been discovered that introducing ambient air in that fashion permits a major reduction in the volume of the mixing chamber. The diameter being controlled in large degree by the diameter of the cigarette, volume reduction really means reduction in the length of the mixing chamber.

In FIG. 13, the forward end 302, which is called the "coupler" of the holder 300, has a diameter to receive the end of a cigarette. There are several standard cigarette diameters and the couplers are made to receive the end of cigarettes of a given size, and sometimes of two different sizes. The inner diameter of this coupler 302 is made to receive the one most frequently encountered cigarette diameter. The inner diameter is reduced at a point along its length to form a shoulder 304. The shoulder serves as a stop to limit the degree in which the cigarette may be inserted. The end of the cigarette forms one end of the mixing chamber, the upper face of the barrier disc 306 forms the other end of the chamber. That length need be no more than one-half millimeter.

Although the holder is shown enlarged in FIG. 13, its proportions correspond to the proportions in an actual holder which removes an average of about sixty-five percent of the tar and nicotine products when tested with a number of popular cigarette brands. The mixing chamber is very short and that has a very practical advantage because acceptance of this product depends upon social and aesthetic factors. Making the mixing chamber short moves the cigarette end closer to the smoker's mouth and that increases acceptability in markets where filters are accepted but cigarette holders are not.

Performance is improved in the short mixing chamber apparently because the air is introduced through channels that open to the chamber at several spaced points around its periphery. However, the proportion of the smoke components that are removed in the mixing chamber (accellerating passage) filter type of filter device depends in large measure upon the amount of air that reaches the mixing chamber. The end portion of a cigarette is quite pliant and resilient. When forced into the coupler of the holder, the end is compressed and the exterior tends to bulge into the inlet air flow channels 308, 310 and 312. At first blush, it would seem that this bulging effect would tend to block air flow through the channels and alter or defeat the filtering action. To prevent that, the channels are made narrow and relatively deep. The amount of air inflow is controlled by increasing or decreasing the number of channels.

However, while the problem of air flow blockage can be adequately controlled by groove and coupler design, the matter is not left to chance in the preferred embodiment. FIG. 17 shows, in near actual size, the end of a cigarette that was inserted into the coupler 302 of holder 300, down to the stop 304, and then removed. The cigarette end has been deformed to include three tucks or V-shaped indentations which are deepest at the very end 314 of the cigarette and become more shallow and, finally, disappear in the direction along the cigarette away from the end.

Those tucks were formed by ribs which extend from the inner surface of the coupler 302. There are three ribs in this sixty-five percent model numbered 316, 318 and 320 which are responsible for tucks 322, 324 and 326, respectively, in the cigarette 330 of FIG. 17, The preferred material for making these holders is plastic, usually polypropolene. To facilitate removal of parts from the molds in which they are produced, walls and holes are tapered to slightly larger dimension at the direction in which the tool is to be drawn from the part. This "draft" is slight and is not very evident in FIGS. 13 through 16. Its effect, however, is to compress the end of a cigarette in greater degree as it is forced to greater depth in the coupler. Because of that, the tendency to bulge into the air channels is greater in the direction toward the stop 304 and less at the coupler rim. The rib design recognizes those facts—the need for draft and the need for increased tucking against bulging toward the stop 304. In this preferred form, the ribs are V-shaped in cross-section. The bottom of the "V" projects toward the central coupler axis and the cross-sectional area diminishes toward the coupler rim where the V-shape has tapered to zero.

The design of the air passageways and the V-shaped "tuck makers" are preferred when the interior wall of the coupler are formed of plastic and, more generally, when the coupler is to be molded. Another configuration may be preferred when the coupler is formed of metal in a drawing or other process.

The smoke and air mixture is accelerated as it leaves the mixing chamber and passes through the central opening 332 of the barrier disc.

The disc is press-fitted into place. It is seated against three projections which are formed on its inner surface integrally with the holder in the mid region of its length. They are numbered 340, 342, and 344. They project inwardly and at their inner margins are integrally formed with the sleeve 346. The construction is best shown in FIG. 13.

Figure 3:
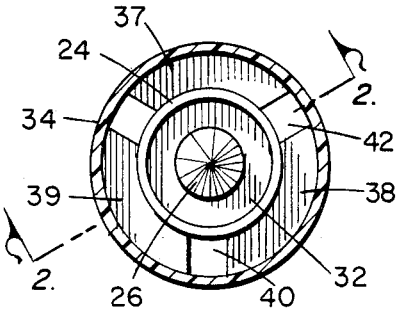
FIG. 3 is a cross-sectional view of the unit taken on line 3—3 of FIG. 2.

Sleeve 346 of FIG. 13 corresponds to sleeve 24 of FIGS. 2, 3 and 4, and it serves the same purpose as sleeve 24. The lower end of the sleeve is closed by the end of the conical target 348 which corresponds to the target 26 and stub combination of FIGS. 2, 3 and 4. In this case, the cone is taller, flares out at its lower end, and extends to the lower end of the sleeve 346. The bottom wall is similarly coned except that it is the cut away portion, or recess 350, which is conical. The target and sleeve construction of FIG. 13 is easier to produce than is the structure of FIG. 2, and it functions as well or better than the arrangement of FIG. 2.

Although I have shown and described certain specific embodiments of my invention, I am fully aware that many modifications thereof are possible. My invention, therefore, is not to be restricted except insofar as is necessitated by the prior art.

I claim:

1. For a cigarette filter of the type that includes a barrier which extends across the smoke flow path, an air and smoke mixing chamber upstream from the barrier and openings, one by which ambient air flows into the chamber and the other by which a stream of smoke, air and condensate flows through the barrier, an improved condensate collector which comprises:

means in the form of a cone surface in the path of the stream of smoke, air and condensate and which is wetted by the condensate for intercepting condensate as it flows through the barrier;

said cone being oriented at an angle to the direction of flow of said stream such that the condensate intercepted at a point on said surface tends to adhere to the wetted surface and such that the smoke and air are directed against previously intercepted condensate and exert a force tending to move said condensate along said surface to a position beyond the point of interception; and means for conducting ambient air into said chamber in parallel with said smoke path via a plurlaity of air inlet paths opening at spaced points around the periphery of said mixing chamber at its upstream end.

2. A tubular apparatus for separating unwanted components from tobacco smoke by mixing the smoke emerging from a tobacco product with ambient air and for filtering unwanted components from the air and smoke mixture, which apparatus includes:

an upstream section comprising, in series, a forward opening of size to receive the end portion of a tobacco product, a tobacco product retaining cavity the walls of which are arranged to receive and hold the end portion of said tobacco product, and a mixing chamber in which smoke emerging from said end of the tobacco product can mix with ambient air, said upstream section further comprising air inlet means for introducing air into the mixing chamber from said forward opening past the tobacco product in the form of conformations in said walls of the product retaining cavity for permitting a flow of air past said tobacco product from said forward opening to said mixing chamber;

a downstream section through which smoke and air entering the upstream end of said section may be passed to a smoker; and a mid-section comprising a barrier extending across the interior of said tubular apparatus and forming the downstream end of said mixing chamber, said barrier being formed with a smoke accelerating opening affording communication from said mixing chamber to said downstream section.

3. The invention defined in claim 2 which further comprises peripheral dimension reducing means in the form of inwardly projecting ribs formed on said wall of said upstream section for preventing said tobacco product from blocking air flow through said air inlet means by indenting the peripheral dimensions of the tobacco product at selected points around its outer wall upon entry into said retaining cavity.

4. The invention defined in claim 2 in which said walls of the product retaining cavity include stop means in the form of conformations on said walls for limiting the degree of insertion of a tobacco product such that the tobacco product, when inserted, forms the upstream wall of said mixing chamber.

5. In a cigarette filter, a filter body including an end opening the walls of which are capable of receiving and retaining the end of a cigarette inserted therein;

insertion limiting means in said body for limiting the degrees of insertion of a cigarette into said end opening for forming a chamber, one wall of which is formed by the end of the cigarette;

means in the form of passageways formed on the inner surface of said wall for admitting air into said chamber past a cigarette and past said insertion limiting means; and means in the form of longitudinally extending ribs projecting inwardly into said end opening for forming inwardly extending longitudinal tucks to be formed in the outer wall of a cigarette when the cigarette is inserted into said end opening.

6. For a cigarette filter of the type that includes a barrier which extends across the smoke flowpath, an air and smoke mixing chamber upstream from the barrier and flowpaths, one by which ambient air flows into the chamber and the other by which a stream of smoke, air and condensate flows through the barrier, an improved condensate collector which comprises:

means in the form of a sloping surface in the path of the stream of smoke, air and condensate and which is wetted by the condensate for intercepting condensate as it flows through the barrier;

said sloping surface being oriented at an angle to the direction of flow of said stream such that the condensate intercepted at a point on said surface tends to adhere to the wetted surface and such that the smoke and air are directed against previously intercepted condensate and exert a force tending to move said condensate along said surface to a position beyond the point of interception, the sloping surface ending at a base; and means in the form of a sleeve joined to said sloping surface at said base for forcing a reversal of flow of said mixture to a region between said barrier and said sloping surface, and means in the form of an outer wall for receiving flow of the mixture from said sleeve at said region and redirecting it along the outside of said sleeve to a point beyond said base and said sleeve.

* * * * *